US006260743B1

(12) United States Patent
Mazzenga

(10) Patent No.: US 6,260,743 B1
(45) Date of Patent: Jul. 17, 2001

(54) GROUT DISPENSING APPARATUS

(76) Inventor: Gino A. Mazzenga, 21 Spring Meadow Ct., Cranston, RI (US) 02910

( * ) Notice: Subject to any disclaimer, the term of this patent is extended or adjusted under 35 U.S.C. 154(b) by 0 days.

(21) Appl. No.: 09/491,536

(22) Filed: Jan. 26, 2000

(51) Int. Cl.[7] ..... A01C 5/64

(52) U.S. Cl. ..... 222/611.2; 118/323; 118/313; 401/16; 401/137; 425/62

(58) Field of Search ..... 222/608, 611.2, 222/611.1, 612, 626, 318, 330, 331, 333

(56) References Cited

U.S. PATENT DOCUMENTS 1,829,479 * 10/1931 Elkins ..... 401/16
2,535,726 * 12/1950 Dalton ..... 72/135
3,186,689 * 6/1965 Davies ..... 259/44
3,562,808 * 2/1971 Whitley ..... 222/177
5,358,568 * 10/1994 Okano ..... 118/323
5,681,125 * 10/1997 Amaya ..... 401/146
5,878,921 * 3/1999 Chase et al. ..... 222/333

* cited by examiner

*Primary Examiner*—Kevin Shaver
*Assistant Examiner*—Melvin Cartagena
(74) *Attorney, Agent, or Firm*—Dale J. Ream

(57) ABSTRACT

An apparatus for dispensing grout into joints formed between laterally adjacent floor tiles comprises a hopper for holding a quantity of grout mounted on a mobile frame assembly. The apparatus includes a plurality of nozzle assemblies coupled to the hopper through tubular channels. The nozzle assemblies are slidably coupled to a mounting bracket which extends parallel to the front of the frame assembly such that the lateral distance between the nozzle assemblies is adjustable to correspond to the lateral distance between the joints formed by various sizes of floor tiles. A rack and pinion assembly is connected to the mounting bracket such that the vertical distance between the nozzle assemblies and the floor tiles is also adjustable.

18 Claims, 8 Drawing Sheets

GROUT DISPENSING APPARATUS

BACKGROUND OF THE INVENTION

The present invention relates generally to an apparatus for dispensing grout and, more particularly, to a wheeled apparatus having multiple grout dispensing nozzles that are vertically and horizontally adjustable for simultaneously dispensing grout into multiple grout lines about tiles.

Grout is a thin mortar for filling cracks or joints such as those formed between tiles on a floor, shower wall, or the like. Grout is generally applied by spreading grout over the entire tile surface, compacting it into the joints, and then wiping the excess grout off of the tile surfaces before it dries. The grout can only be applied to small areas at a time because of the necessity of cleaning the grout off of the tile surfaces before it hardens. The inherent disadvantages of applying grout to tile surfaces are the time requirements for completing large jobs and the labor intensity of bending or working on one's knees.

Systems which use a hand-held device similar to a caulking gun for applying grout directly into joints have been proposed in U.S. Pat. Nos. 5,571,538 and 5,314,100. Although assumably effective for their intended purposes, the existing devices do not allow grout to be applied simultaneously and uniformly in multiple joints.

Therefore, it is desirable to have an apparatus with multiple nozzle assemblies which can simultaneously and uniformly dispense grout into the joints between tiles. It is further desirable to have an apparatus in which each of the nozzle assemblies is laterally and vertically adjustable for use with tiles of various dimensions.

SUMMARY OF THE INVENTION

Accordingly, an apparatus for dispensing grout constructed according to the present invention includes a mobile frame assembly having a base with front and rear walls and spaced apart side walls therebetween. The apparatus further includes a hopper for holding an amount of grout. An auger is mounted within the hopper and is coupled to an elongate shaft extending longitudinally in the hopper. A lid is releasably attached to the hopper and includes an electric motor. The shaft is engaged by the electric motor when the lid is secured to the hopper to operate the auger.

A plurality of tubular channels are coupled to an end of the hopper into which grout is delivered as the auger operates. Each channel is connected to one of a plurality of nozzle assemblies adapted to dispense grout. Each nozzle assembly is slidably connected to a mounting bracket which is displaced from and extends parallel to the front wall of the mobile frame assembly. Therefore, the nozzle assemblies are selectably slidable along the mounting bracket so as to position each nozzle assembly above a joint between tiles. A rack and pinion gear assembly is also coupled to the mounting bracket for increasing or decreasing the distance between the nozzle assemblies and the joints between tiles. Therefore, the adjustability of the nozzle assemblies enables the present apparatus to be used to properly dispense grout into the joints between tiles of various sizes and into joints of various depths.

Therefore, a general object of this invention is to provide an apparatus having multiple nozzles assemblies for dispensing grout simultaneously into the joints between multiple tiles.

Another object of this invention is to provide an apparatus, as aforesaid, in which each nozzle assembly is laterally slidable along a mounting bracket such that the nozzle assemblies can dispense grout into joints between tiles having various dimensions.

Still another object of this invention is to provide an apparatus, as aforesaid, in which the distance between the nozzle assemblies and respective joints is adjustable.

Yet another object of this invention is to provide an apparatus, as aforesaid, having continuous track wheel assemblies for moving the nozzle assemblies along respective joints without disrupting previously grouted areas.

A further object of this invention is to provide an apparatus, as aforesaid, which can deliver grout from a refillable hopper to each nozzle assembly.

A still further object of this invention is to provide an apparatus, as aforesaid, which is powered by rechargeable batteries.

Another object of this invention is to provide an apparatus, as aforesaid, having a hand-held nozzle assembly for dispensing grout into joints not accessible by the plurality of nozzle assemblies Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
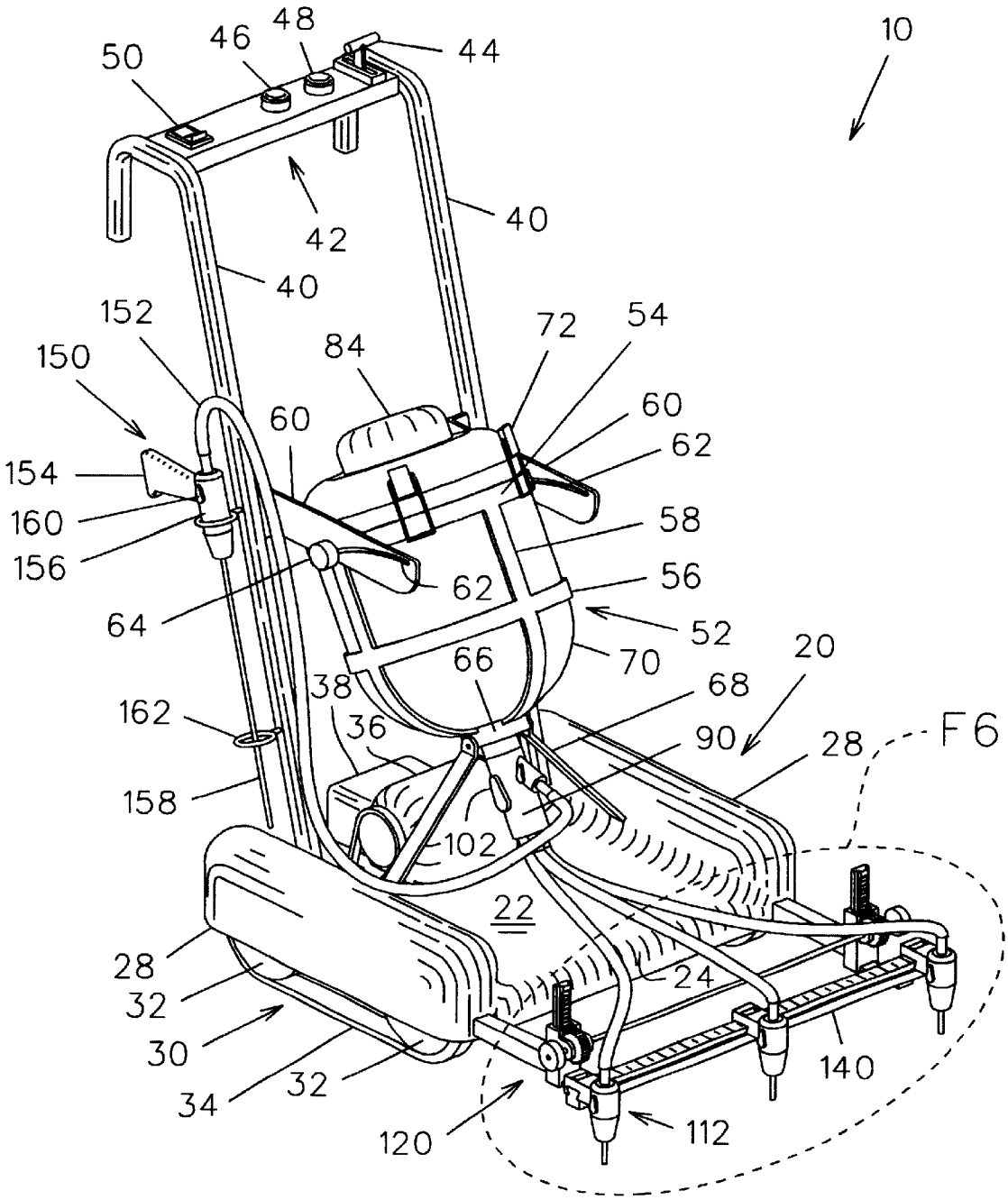
FIG. 1 is a perspective view of the grout dispensing apparatus according to the present invention.
Figure 2:
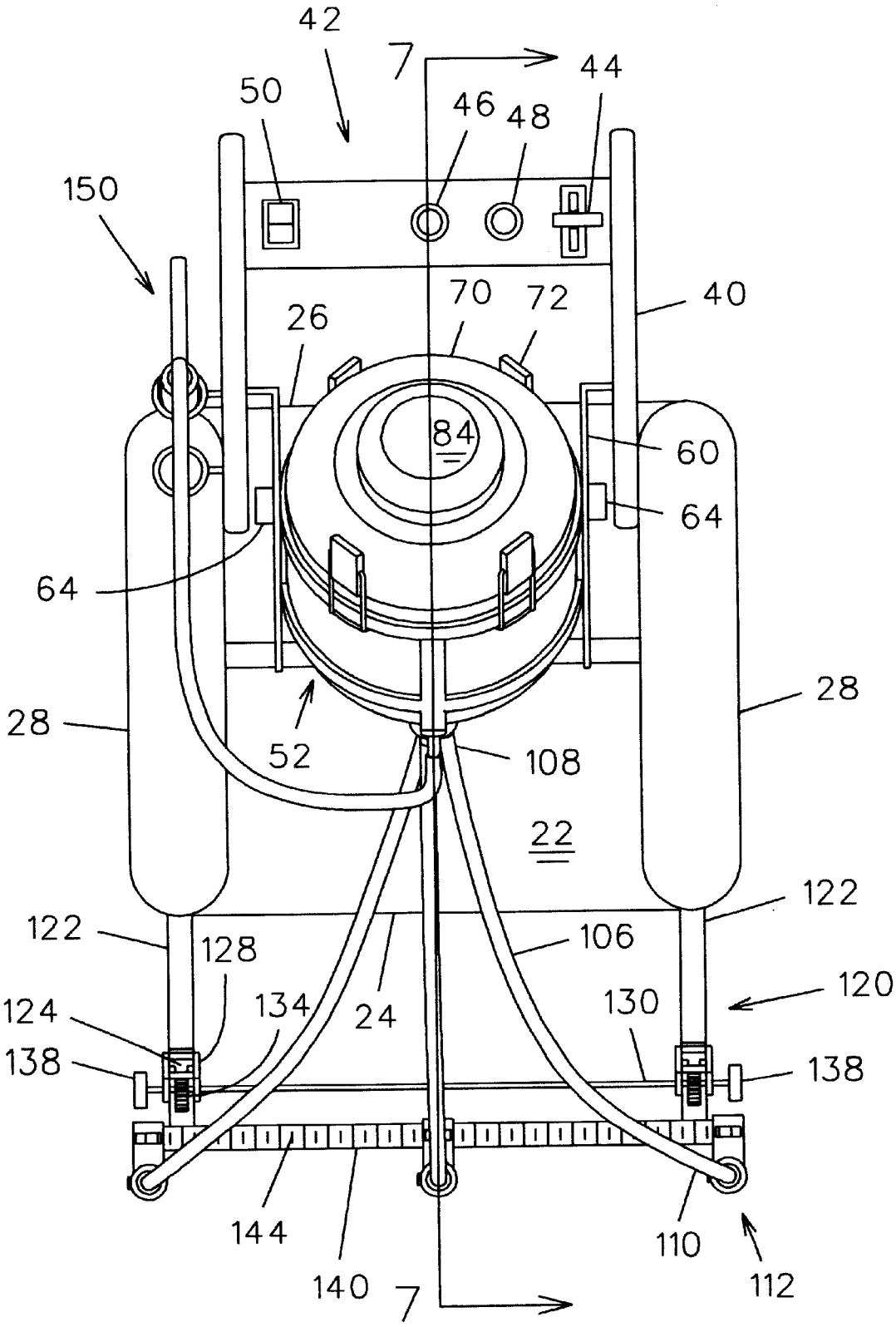
FIG. 2 is a top view of the apparatus as in FIG. 1.
Figure 3:
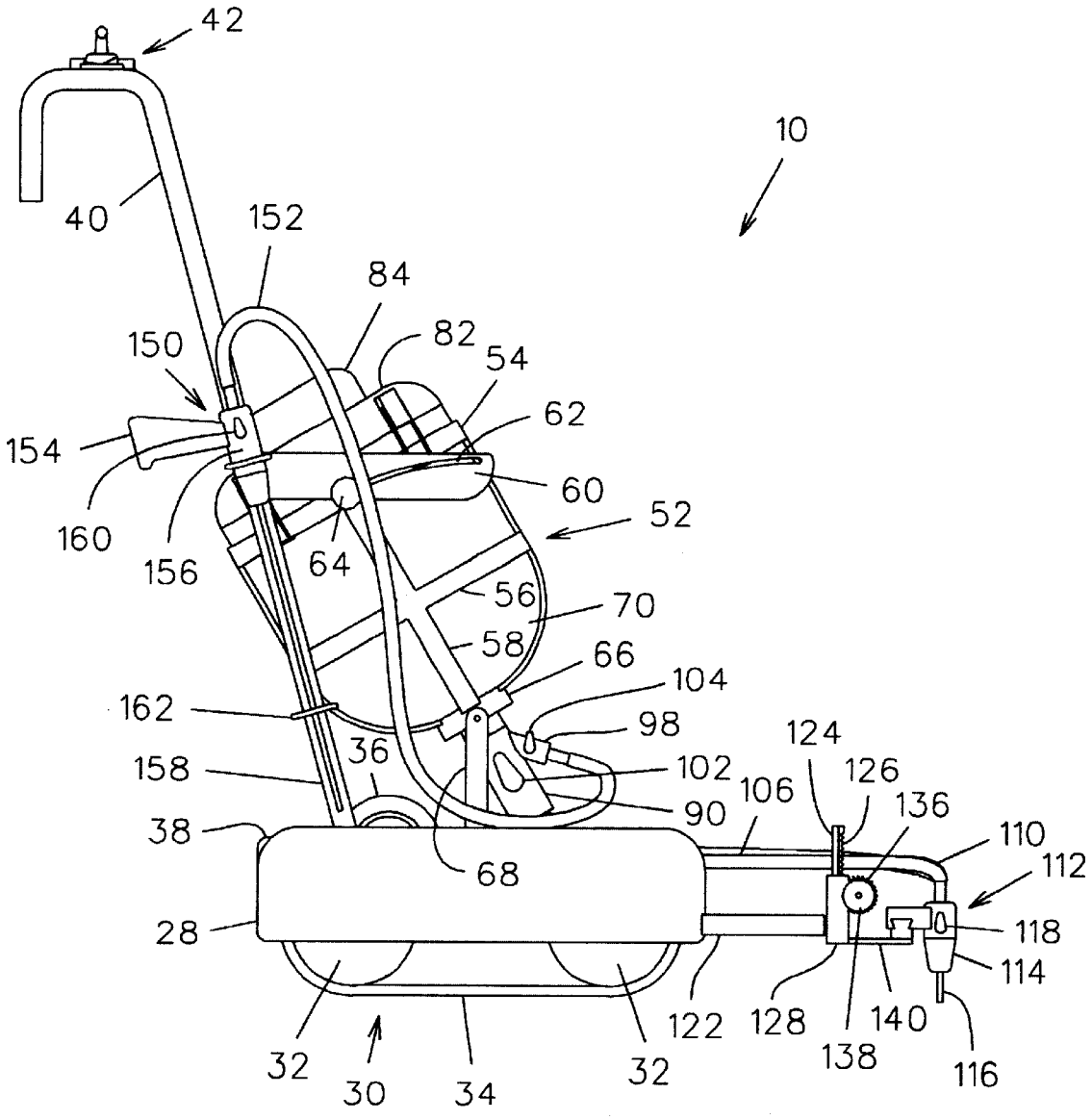
FIG. 3 is a side view of the apparatus as in FIG. 1 with the hopper in a first angled position.
Figure 4:
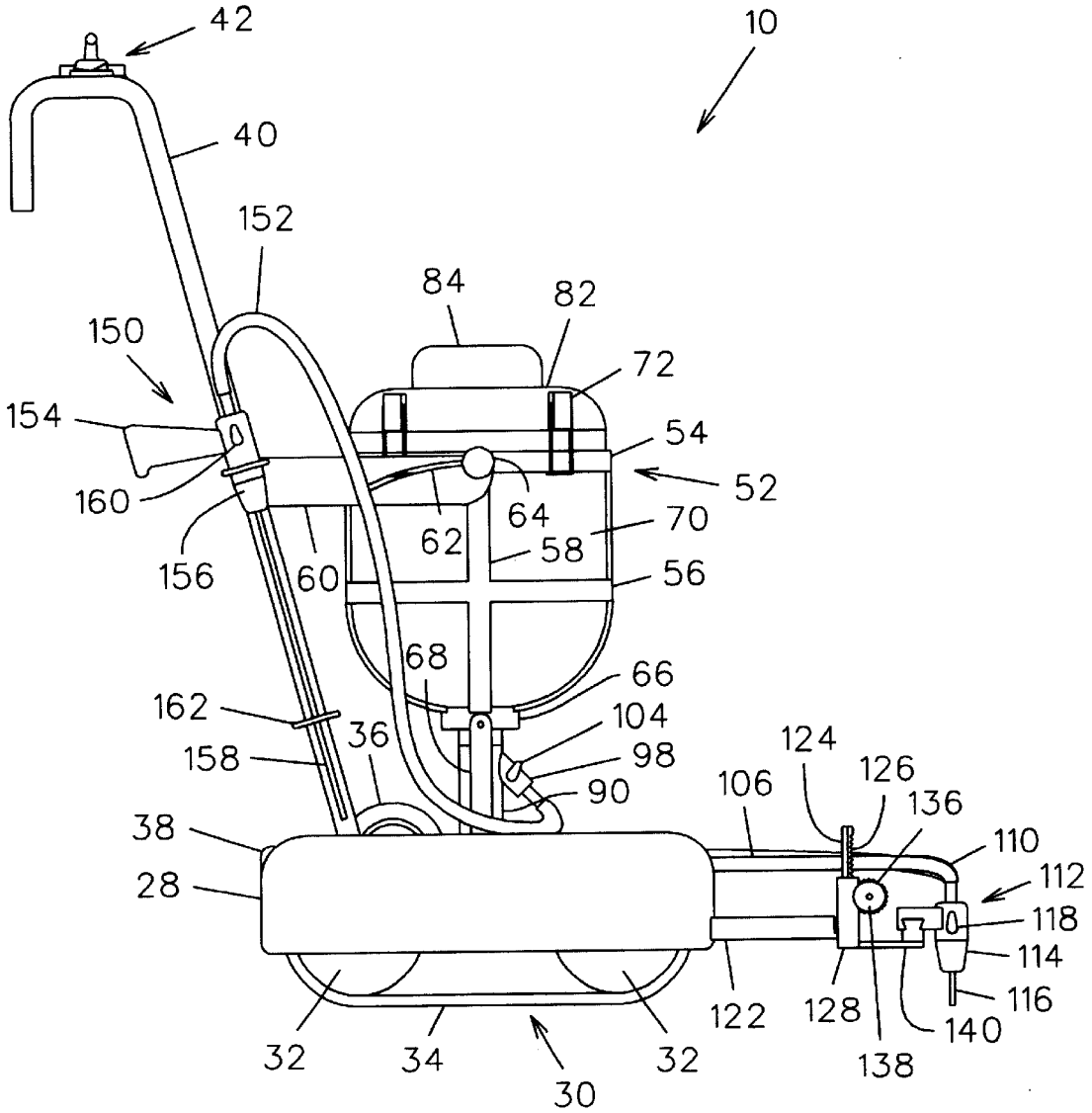
FIG. 4 is a side view of the apparatus as in FIG. 1 with the hopper in a second vertical position.
Figure 5:
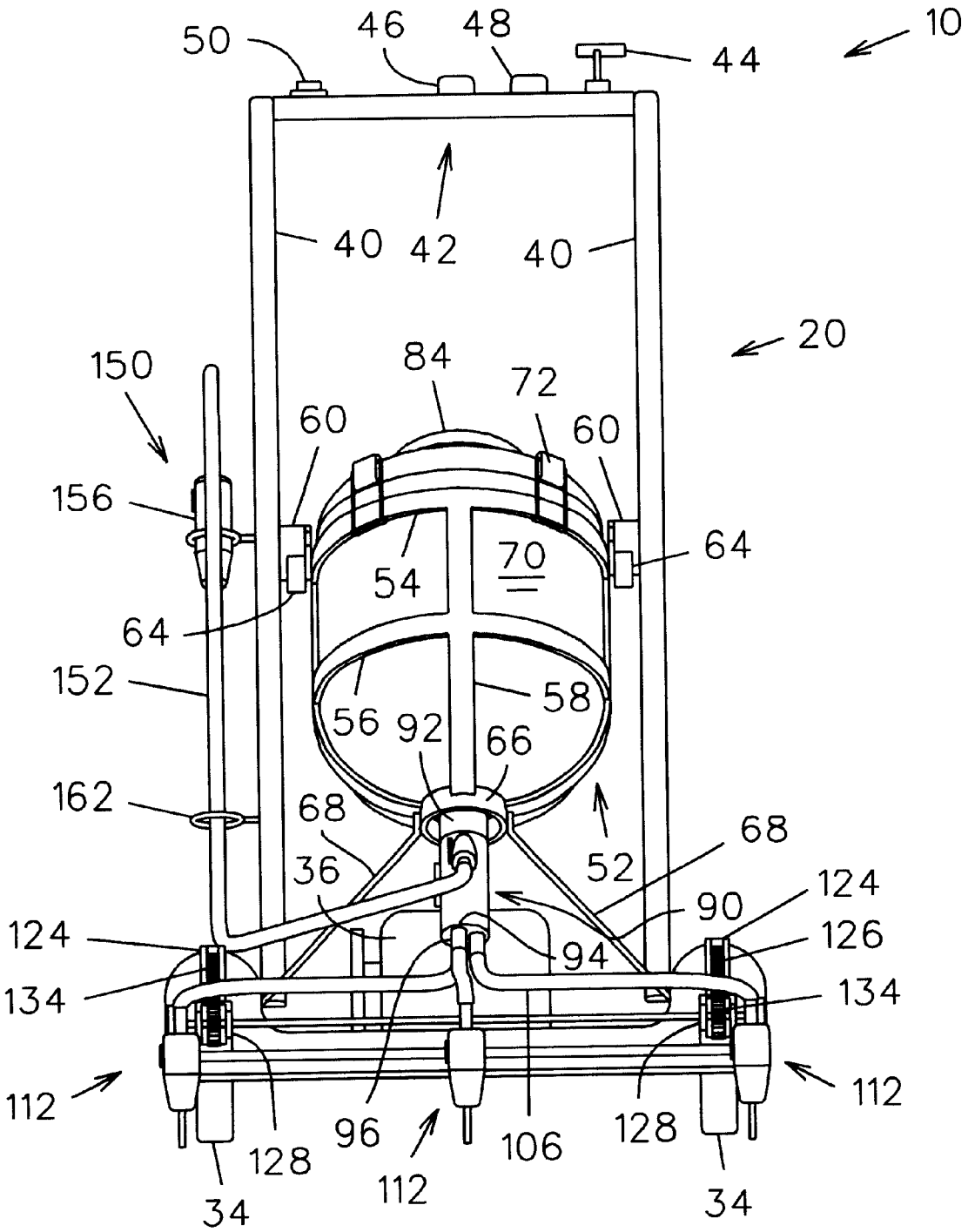
FIG. 5 is a front view of the apparatus as in FIG. 1.

An apparatus 10 for dispensing grout constructed according to the preferred embodiment of the present invention is shown in FIGS. 1–8. The apparatus 10 includes a mobile frame assembly 20 having a base platform 22 with front 24 and rear 26 walls. Spaced apart side walls 28 extend between the front 24 and rear 26 walls. Each side wall 28 presents a generally U-shaped configuration having an open bottom for housing a wheel assembly 30. Each wheel assembly 30 includes a pair of drive wheels 32 and a continuous belt-like track 34 extending about the wheels 32 (FIGS. 3 and 4). The track 34 is constructed of rubber or other flexible material which will not disturb grout already dispensed in a joint between tiles, as to be further described below. The drive wheels 32 are connected to a first electric motor 36 mounted on the base 22 of the frame assembly 20 (FIG. 1). The first electric motor 36 is electrically connected to a rechargeable battery within a battery housing 38 on the base 22. Although a conventional power cord or pneumatic hose would also be suitable power sources for the first electric motor 36, use of battery power is preferable in that no cords or hoses are needed which could disrupt grout that has not yet cured.

A pair of handles 40 are pivotally coupled to the base 22 adjacent the rear wall 26 and extend upwardly therefrom. The handles 40 are pivotal so as to accommodate users of different heights. A control panel 42 extends between the handles 40 adjacent free ends thereof (FIG. 1). The control panel 42 includes a lever 44 which is electrically connected to a clutch and gear assembly (not shown) of the wheel assemblies 30. Accordingly, the frame assembly 20 can be moved forward or backward or placed in neutral, as desired by a user. The control panel 42 also includes a variable speed controller 46 electrically connected to the first motor for controlling the speed of the first electric motor 36 and thus the speed of the drive wheels 32. Electrical connections are known in the art and, therefore, are not shown.

The apparatus 10 further includes a framework 52 having a first annular support member 54 and a plurality of vertical support members 58 depending therefrom. The framework 52 also includes a second annular support member 56 spaced apart from the first annular support member 54. The vertical support members 58 are downwardly inwardly arcuate such that the framework 52 provides a receptacle for a grout hopper 70, as to be further described below. The first annular support member 54 includes a pair of opposed threaded recesses.

A pair of support arms 60 are fixedly attached to respective handles 40. Each arm 60 includes a slot 62. A knob 64 having a threaded shaft extending therefrom can be inserted through each slot 62 and into respective threaded recesses of the support member 54 and tightened for holding the framework 52 at a desired position relative to the slot 62. A collar 66 is attached to lower free ends of the vertical support members 58 and pivotally attached to the base 22 with spaced apart struts 68.

The apparatus 10 further includes a hopper 70 for storing a quantity of grout to be dispensed. The hopper 70 is configured to slidably mate with the framework 52. The hopper 70 includes a plurality of fasteners 72 for selectably securing the hopper 70 to the framework 52. The hopper 70 includes a first end having a neck portion 74 which extends through the collar 66 when the hopper 70 is resting in the framework 52. An aperture is formed in the end of the neck portion 74. An auger 76 is mounted within the neck portion 74 and includes an elongate shaft 78 extending therefrom longitudinally through the hopper 70. The shaft 78 includes a free end 80 having a socket configuration.

A large aperture is formed in an opposed second end 82 of the hopper 70 for depositing grout into the hopper 70 therethrough. A lid 84 is releasably coupled to the second end 82 for covering the aperture. The lid 84 is threadably coupled to the hopper 70 although the use of clips, clamps, or other fasteners would also be suitable. A second electric motor is housed within the lid 84 and selectively coupled to the battery (not shown). When the lid 84 is coupled to the hopper 70, the shaft 78 engages the second motor. An on/off switch 50 mounted on the control panel 42 is used to activate the second motor. A pair of arcuate agitator rods 88 are fixedly attached to the shaft 78 and operate to agitate or stir the grout within the hopper 70 upon rotation of the shaft 78. Accordingly, the hopper may be filled with grout and then dispensed through the aperture in the neck portion 74 by gravitational forces aided by operation of the auger 76. It should be appreciated that the second electric motor may be a variable speed motor coupled to a second speed controller 48 on the control panel 42 such that the flow rate of grout through the neck portion aperture is selectively variable.

The apparatus 10 further includes a nozzle coupling 90 frictionally attached at a first end 92 to the neck portion 74 of the hopper 70. The coupling 90 may be separated easily from the neck portion 74 when the hopper 70 is removed from the framework 52 or for cleaning purposes. A plurality of primary outlets 96 are formed in a second end 94 of the nozzle coupling 90. A secondary outlet 98 is formed in a side wall 100 of the coupling 90. The coupling 90 includes a main shutoff valve 102 positioned to selectively regulate the flow of grout through the primary outlets 96. A second valve 104 is positioned on the secondary outlet 98 for regulating the flow of grout therethrough.

Figure 6:
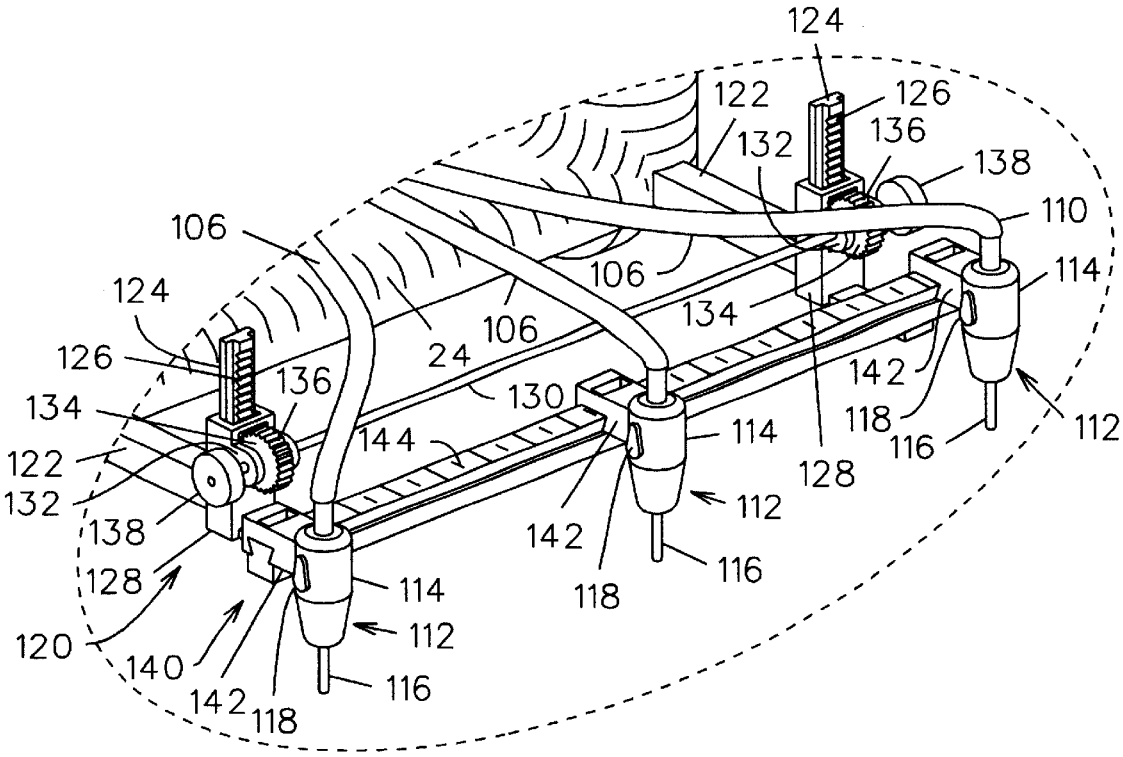
FIG. 6 is a perspective view of the nozzle assemblies and adjustment assemblies on an enlarged scale taken from FIG. 1.
Figure 7:
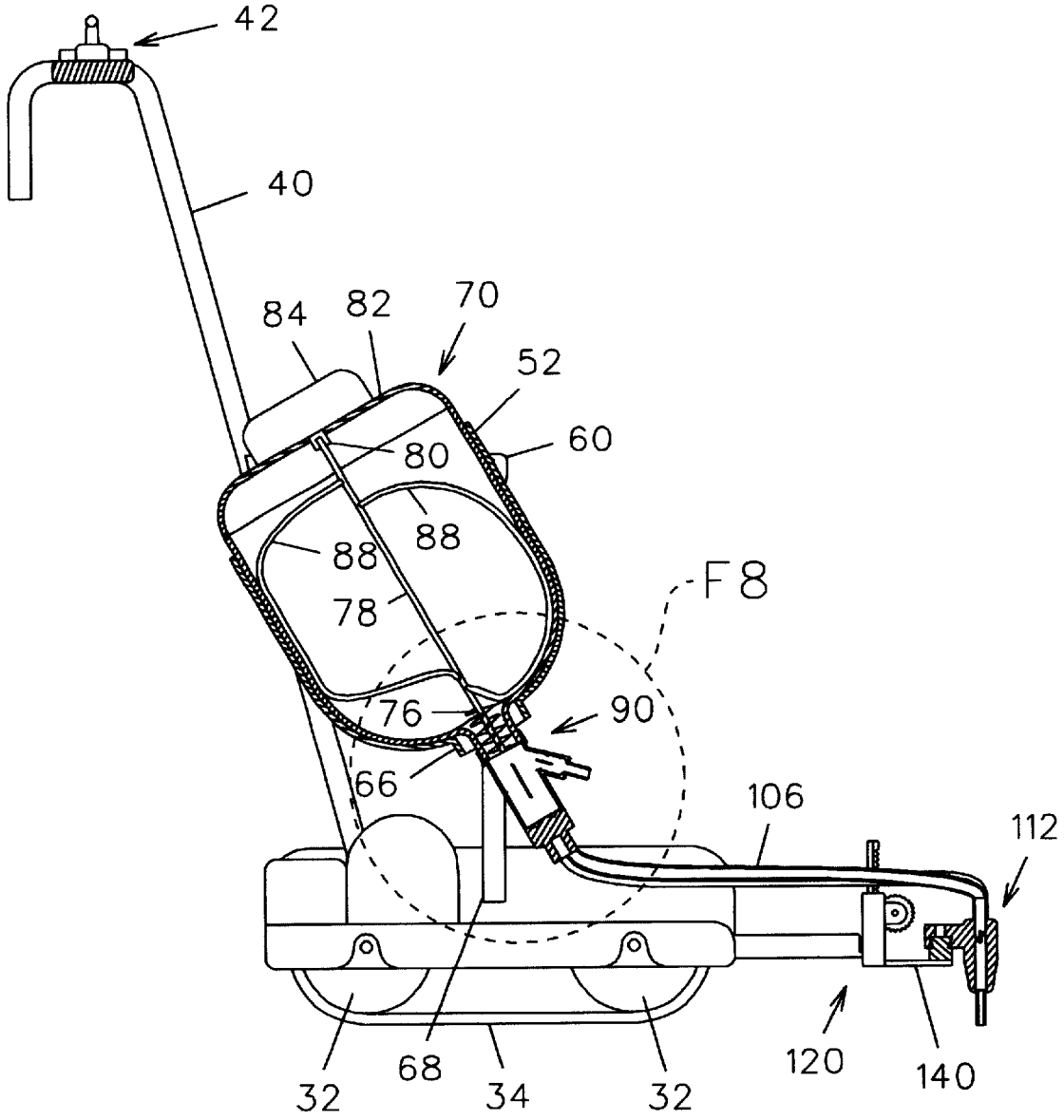
FIG. 7 is a sectional view taken along line 7—7 of FIG. 2.
Figure 8:
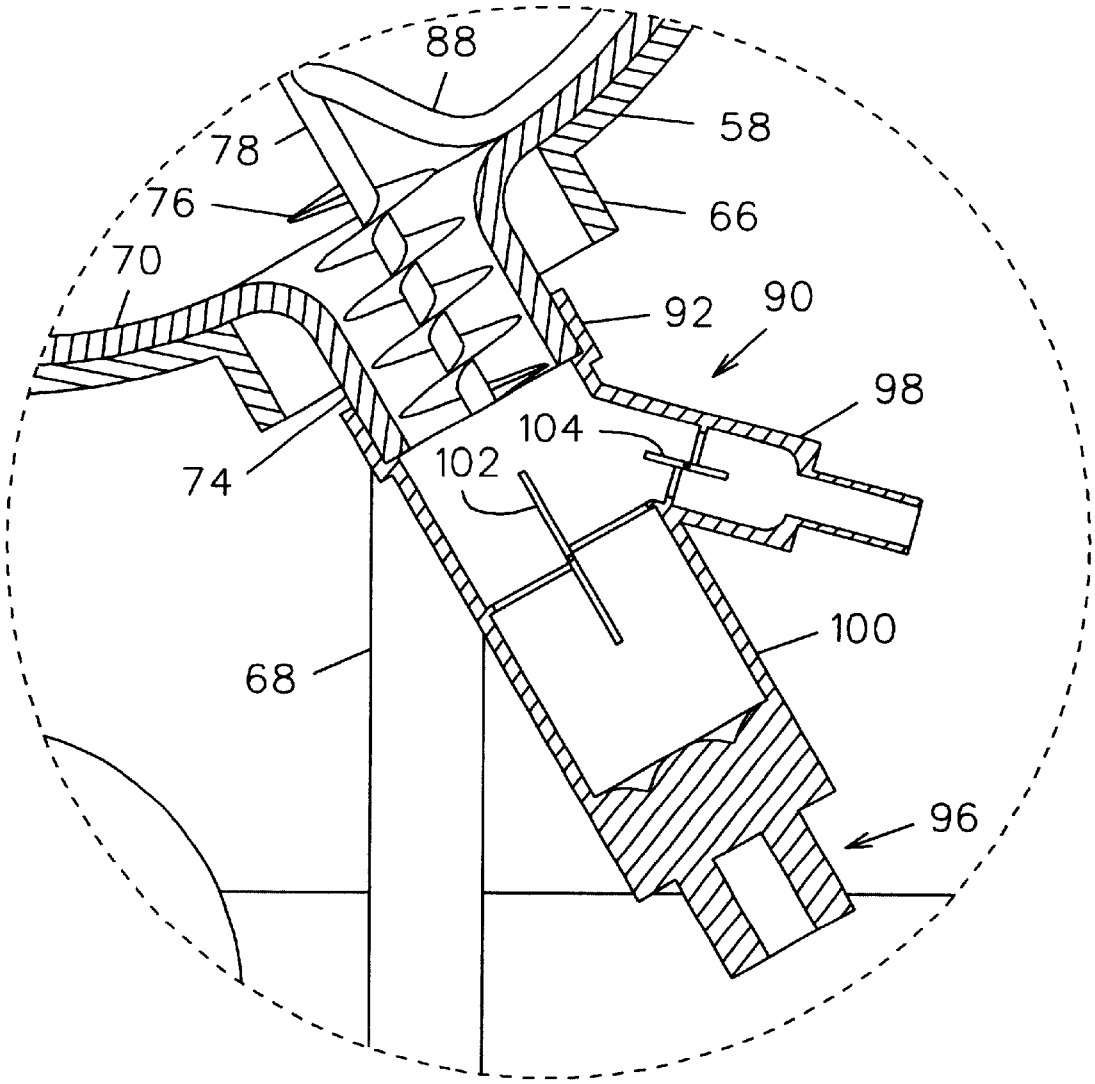
FIG. 8 is a view of the neck assembly of FIG. 7 on an enlarged scale.

Each primary outlet 96 is coupled to a first end 108 of a tubular channel 106, the channel being a rubber hose or conduit. A second end 110 of each channel 106 is connected to a nozzle assembly 112 having a nozzle housing 114 and a dispenser tip 116 (FIG. 6). Each nozzle housing 114 includes a valve 118 for individually regulating the flow of grout through the tip 116.

As best shown in FIG. 6, the apparatus 10 includes a mounting assembly 120 for retaining and positioning the nozzle assemblies 112 above a work surface. The mounting assembly 120 includes a pair of spaced apart bars 122 fixedly attached to and extending from the front wall 24 of the mobile frame assembly 20. A pair of racks 124 having a plurality of teeth 126 are normal to ends of respective bars 122, the racks 124 extending vertically therefrom. Each rack 124 extends through a bore in a rack housing 128, the rack housing 128 being slidable therealong as to be described below. The rack housings 128 are connected by a guide bar 130 extending through respective flanges 132 on the housings 128. Pinion gears 134 having teeth 136 are pivotally coupled to the guide bar 130 and positioned to mesh with the teeth 126 of respective racks 124. Accordingly, as an adjustment knob 138 attached to an end of the guide bar 130 is rotated, the rack housings 128 are selectively raised or lowered.

A mounting bracket 140 is fixedly attached to the rack housings 128 and extends therebetween. The mounting bracket, therefore, is also raised or lowered by operation of the rack and pinion arrangements. It is understood that other vertical adjustment means could also be utilized, such as sleeved shafts with selectable pin placement, an incrementally adjustable socket arrangement, or the like.

The nozzle assemblies 112 are slidably coupled to the mounting bracket 140 with mounting clips 142. Each clip 142 includes a female channel which slidably mates with a male attachment structure extending longitudinally along the mounting bracket 140 and is frictionally held in the desired position. The mounting bracket 140 also includes scale indicia 144 thereon to aid proper positioning of the nozzle assemblies 112 thereon according to the dimensions of the tile being grouted. It should be appreciated that each nozzle assembly 112 can be slidably removed from the mounting bracket 140 and replaced, if necessary.

The apparatus 10 further includes a hand-held nozzle assembly 150 connected to the nozzle coupling 90 with a tubular channel 152 as described above. The hand-held nozzle assembly 150 includes a handle 154, nozzle housing 156 and an elongated dispenser tip 158. The nozzle housing 156 includes a valve 160 for regulating the flow of grout to the dispenser tip 158. The hand-held nozzle assembly 150 can be stored in ring fasteners 162 attached to a handle 40 when not in use.

In operation, the lid 84 is removed from the hopper 70 and previously mixed grout is deposited therein or, alternatively, the grout can be mixed in the hopper 70 itself. With the lid 84 coupled to the hopper 70, the second motor may be activated by a user pressing the on/off switch 50. As the shaft 78 is rotated, the grout is agitated and delivered from the hopper 70 to the nozzle coupling 90. If the main valve 102 is open, grout is further delivered to the plurality of nozzle assemblies 112 through the channels 106. If the valve 104 is open, grout is delivered to the hand-held nozzle assembly 150. The nozzle assemblies 112 may be slidably positioned along the mounting bracket 140 according to the distance between joints of the tile surface. The nozzle assemblies may also be vertically adjusted according to the depth of the joints to be filled with grout.

The variable speed controller 48 may be adjusted by a user to modify the speed of the second motor and therefore the flow rate of grout to the nozzle assemblies 112. The variable speed controller 46 may be adjusted by a user to modify the speed of the first motor 36 and thus the speed of the drive wheels 32 which provide forward or backward movement to the mobile frame assembly 20. The valve 104 to the hand-held nozzle assembly 150 may be opened for dispensing grout therethrough when application of grout to areas not accessible to the other nozzle assemblies 112 is desired.

In addition, the tightening knobs 64 may be loosened and the framework 52 pivoted rearward during use to enhance a user's line of sight relative to the nozzle assemblies 112. As the framework 52 is pivoted, the shafts slide along the slots 62 to a desired position whereat the knobs 64 can be tightened again, as in FIGS. 3 and 4.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An apparatus for dispensing grout into joints formed between laterally adjacent floor tiles, comprising:

a container adapted to hold a quantity of grout;

a plurality of laterally spaced apart nozzle assemblies, each said nozzle assembly adapted to dispense grout into one of the joints;

a plurality of tubular channels, each channel having a first end coupled to said container and a second end coupled to a corresponding nozzle assembly for delivering grout from said container to said corresponding nozzle assembly, whereby grout is dispensed into the joints formed between laterally adjacent floor tiles;

a frame assembly having front and rear walls and a pair of side walls extending therebetween, said frame assembly including a base plate between said side walls;

a pair of spaced apart handles coupled to said base plate and extending upwardly therefrom, said handles adapted for user grasping such that said frame assembly is movable by a user along the floor tiles;

a pair of drive wheel assemblies coupled to said side walls of said frame assembly, each wheel assembly including a pair of drive wheels and a continuous track extending about said pair of drive wheels; and a first electric motor connected to said drive wheels for moving said nozzle assemblies along the joints between the floor tiles.

2. An apparatus as in claim 1 further comprising:

a pair of support arms fixedly attached to said handles, each support arm defining a slot therein;

a bracket assembly having a first annular support member and a plurality of vertical support members depending therefrom, said vertical support members being inwardly arcuate for supporting said container and having lower ends pivotally coupled to said base plate; and a pair of opposed fasteners attached to said annular support member and extending through said slots such that said fasteners slide within said slots upon a pivotal movement of said bracket assembly.

3. An apparatus as in claim 1 wherein said container includes a first end defining a first aperture and a second end defining a second aperture, said first aperture being in communication with said nozzle assemblies, said container further including:

an auger adjacent said first end;

an elongate shaft having a first end coupled to said auger and an opposed free end;

a lid releasably coupled to said second end for selectively sealing said second aperture; and a second electric motor mounted in said lid, said second motor being coupled to said free end of said shaft when said lid is at said sealed position for operating said auger to deliver grout from said container to said channels.

4. An apparatus as in claim 1 wherein each said nozzle assembly includes a valve for selectably delivering grout therethrough.

5. An apparatus for dispensing grout into joints formed between laterally adjacent floor tiles, comprising:

a frame assembly having front and rear walls and a pair of side walls extending therebetween;

a hopper removably coupled to said frame assembly and adapted to hold a quantity of grout;

a mounting bracket attached to said frame assembly, said mounting bracket being displaced from said front wall and extending parallel thereto;

a plurality of laterally spaced apart nozzle assemblies slidably coupled to said mounting bracket such that each nozzle assembly is selectably movable along said mounting bracket to laterally spaced positions corresponding to the lateral distance between the joints, each said nozzle assembly adapted to dispense grout into a corresponding joint; and a plurality of tubular channels, each channel having a first end coupled to said hopper and a second end coupled to a corresponding nozzle assembly for delivering grout from said hopper to said corresponding nozzle assembly, whereby grout is dispensed into the joints between the laterally adjacent floor tiles.

6. An apparatus as in claim 5 wherein said frame assembly includes:

a base extending between said side walls;

a pair of spaced apart elongate handles pivotally coupled to said base and extending upwardly therefrom, said handles adapted for user grasping such that said frame assembly is selectively movable by a user along the floor tiles.

7. An apparatus as in claim 6 further comprising:

a pair of support arms fixedly attached to said handles, each support arm defining a slot therein;

a bracket assembly having a first annular support member and a plurality of vertical support members depending therefrom, said vertical support members being inwardly arcuate for supporting said hopper and having lower ends pivotally coupled to said base; and a pair of opposed fasteners attached to said annular support member and extending through said slots such that said fasteners slide within said slots upon a pivotal movement of said bracket assembly.

8. An apparatus as in claim 5 further comprising:

a pair of drive wheel assemblies coupled to said side walls of said frame assembly, each wheel assembly including a pair of drive wheels and a continuous track extending about said pair of drive wheels; and a first variable speed electric motor connected to said drive wheels for moving said nozzle assemblies along the joints between the floor tiles.

9. An apparatus as in claim 8 including means for varying the speed of said first motor to vary the rate at which said drive wheels operate to move said nozzle assemblies along the joints between the floor tiles.

10. An apparatus as in claim 5 further comprising:

a hand-held nozzle assembly releasably coupled to said frame assembly and adapted to dispense grout into a joint;

another tubular channel having a first end coupled to said hopper and a second end coupled to said hand-held nozzle assembly; and a shutoff valve on said hand-held nozzle assembly for selectably dispensing grout from said hand-held nozzle assembly.

11. An apparatus as in claim 5 wherein said hopper includes a first end defining a first aperture and a second end defining a second aperture, said first aperture being in communication with said nozzle assemblies, said hopper further including:

an auger adjacent said first end;

an elongate shaft having a first end coupled to said auger and an opposed free end;

a lid releasably coupled to said second end for selectively sealing said second aperture; and a second variable speed electric motor mounted in said lid, said second motor being coupled to said free end of said shaft when said lid is at said sealed position for operating said auger so as to deliver grout from said hopper to said channels.

12. An apparatus as in claim 11 including means for varying the speed of said second motor to vary the rate at which grout is delivered to said channels.

13. An apparatus as in claim 11 including a pair of spaced apart arcuate bars attached to said shaft for agitating the grout in said hopper to prevent a separation of grout ingredients.

14. An apparatus for dispensing grout into joints formed between laterally adjacent floor tiles, comprising:

a frame assembly having front and rear walls and a pair of side walls extending therebetween;

a hopper removably coupled to said frame assembly and adapted to hold a quantity of grout;

a mounting bracket coupled to said front wall and extending parallel thereto;

means for vertically positioning said mounting bracket at a selected position above the floor tiles;

a plurality of laterally spaced apart nozzle assemblies coupled to said mounting bracket such that each nozzle assembly is selectably movable along said mounting bracket to laterally spaced positions corresponding to the lateral distance between the joints, each said nozzle assembly adapted to dispense grout into a corresponding joint; and a plurality of tubular channels, each channel having a first end coupled to said hopper and a second end coupled to a corresponding nozzle assembly for delivering grout from said hopper to said corresponding nozzle assembly, whereby grout is dispensed into the joints between laterally adjacent floor tiles.

15. An apparatus as in claim 14 wherein said positioning means comprises:

a support arm extending from said front wall;

a rack fixedly attached to said support arm and extending vertically therefrom, said rack having a plurality of teeth;

a rack housing fixedly attached to said mounting bracket and slidably coupled to said rack; and a pinion pivotally coupled to said rack housing having a plurality of teeth adapted to mesh with said rack teeth, whereby said mounting bracket is selectably movable between a first lowered position and a second raised position upon rotation of said pinion by a user.

16. An apparatus as in claim 14 further comprising:

a pair of drive wheel assemblies coupled to said side walls of said frame assembly, each wheel assembly including a pair of drive wheels and a continuous track extending about said pair of drive wheels; and an electric motor connected to said drive wheels for moving said frame assembly along the floor tiles.

17. An apparatus as in claim 14 wherein said hopper includes a first end defining a first aperture and a second end defining a second aperture, said first aperture being in communication with said nozzle assemblies, said hopper further including:

an auger adjacent said first end;

an elongate shaft having a first end coupled to said auger and an opposed free end;

a lid releasably coupled to said second end for selectively sealing said second aperture; and a second electric motor mounted in said lid, said second motor being coupled to said free end of said shaft when said lid is at said sealed position for operating said auger so as to deliver grout from said hopper to said channels.

18. An apparatus as in claim 14 further comprising:

a hand-held nozzle assembly releasably coupled to said frame assembly and adapted to dispense grout into a joint;

another tubular channel having a first end coupled to said hopper and a second end coupled to said hand-held nozzle assembly; and a shutoff valve on said hand-held nozzle assembly for selectably dispensing grout from said hand-held nozzle assembly.

* * * * *